US005280912A

United States Patent [19]

Porter

[11] Patent Number: 5,280,912

[45] Date of Patent: Jan. 25, 1994

[54] BASEBALL GAME APPARATUS

[76] Inventor: Don T. Porter, 5891 Blue Meadow Dr., Salt Lake City, Utah 84118

[21] Appl. No.: 9,023

[22] Filed: Jan. 26, 1993

[51] Int. Cl.[5] ..... A63F 3/00

[52] U.S. Cl. ..... 273/244

[58] Field of Search ..... 273/243, 244, 248, 249, 273/277, 290

[56] References Cited

U.S. PATENT DOCUMENTS

| | | | |
|---|---|---|---|
| 4,000,897 | 1/1977 | York | 273/244 X |
| 4,346,899 | 8/1982 | Nuebling | 273/244 |
| 4,657,254 | 4/1987 | Renner | 273/244 X |
| 4,830,379 | 5/1989 | Richard et al. | 273/244 |
| 4,889,345 | 12/1989 | Wawryk | 273/290 X |
| 4,998,736 | 3/1991 | Elrod | 273/290 X |
| 5,135,230 | 8/1992 | Denman et al. | 273/244 |

FOREIGN PATENT DOCUMENTS

| | | | |
|---|---|---|---|
| 0672436 | 11/1989 | Switzerland | 273/244 |
| 2184028 | 6/1987 | United Kingdom | 273/244 |

*Primary Examiner*—William Stoll
*Attorney, Agent, or Firm*—Leon Gilden

[57] ABSTRACT

A baseball game apparatus arranged to simulate family participation in a baseball game and to reflect the interest and pitfalls of such attendance includes a game board having a first serpentine path of various awards and penalties directed to a stadium, wherein attendance and participation in a baseball game is effected with associated awards and penalties imparted by the use of game cards to direct awards and penalties as to whether the family or family members remain in place, with a second deck of cards provided as location cards to determine where the family is to proceed for that turn, with associated awards and penalties and a third deck of cards relative to problems associated in remaining at the stadium during play of that inning, with nine innings played to associate nine rounds of play relative to the selection of the cards. Return of the family subsequent to a completion of baseball simulation is effected through a second path from the stadium space to return to a home space, with associated awards and penalties with totals effecting status of the players among themselves relative to their dissatisfaction in attending a baseball game as a family unit.

1 Claim, 5 Drawing Sheets

BASEBALL GAME APPARATUS

BACKGROUND OF THE INVENTION

1. Field of the Invention

The field of invention relates to baseball game apparatus, and more particularly pertains to a new and improved baseball game apparatus wherein the same is arranged to reflect family attendance and participation at a baseball game simulation.

2. Description of the Prior Art

Baseball games of various types have been utilized in the prior art and directed to the entertainment and amusement as well as education of individuals relative to baseball. Such game structure is indicated in U.S. Pat. Nos. 4,261,659; 4,179,123; and 3,972,530.

The instant invention attempts to overcome deficiencies of the prior art by focusing on the interplay and relative satisfaction in intense of baseball games by a family unit.

SUMMARY OF THE INVENTION

In view of the foregoing disadvantages inherent in the known types of baseball game apparatus now present in the prior art, the present invention provides a baseball game apparatus arranged to reflect family enjoyment and participation at a simulation baseball game. As such, the general purpose of the present invention, which will be described subsequently in greater detail, is to provide a new and improved baseball game apparatus which has all the advantages of the prior art baseball game apparatus and none of the disadvantages.

To attain this, the present invention provides a baseball game apparatus arranged to simulate family participation in a baseball game and to reflect the interest and pitfalls of such attendance including a game board having a first serpentine path of various awards and penalities directed to a stadium, wherein attendance and participation in a baseball game is effected with associated awards and penalities imparted by the use of game cards to direct awards and penalties as to whether the family or family members remain in place, with a second deck of cards provided as location cards to determine where the family is to proceed for that turn, with associated awards and penalties and a third deck of cards relative to problems associated in remaining at the stadium during play of that inning, with nine innings played to associate nine rounds of play relative to the selection of the cards. Return of the family subsequent to a completion of baseball simulation is effected through a second path from the stadium space to return to a home space, with associated awards and penalties with totals effecting status of the players among themselves relative to their dissatisfaction in attending a baseball game as a family unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball game apparatus which has all the advantages of the prior art baseball game apparatus and none of the disadvantages.

It is another object of the present invention to provide a new and improved baseball game apparatus which may be easily and efficiently manufactured and marketed.

It is a further object of the present invention to provide a new and improved baseball game apparatus which is of a durable and reliable construction.

An even further object of the present invention is to provide a new and improved baseball game apparatus which is susceptible of a low cost of manufacture with regard to both materials and labor, and which accordingly is then susceptible of low prices of sale to the consuming public, thereby making such baseball game apparatus economically available to the buying public.

Still yet another object of the present invention is to provide a new and improved baseball game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
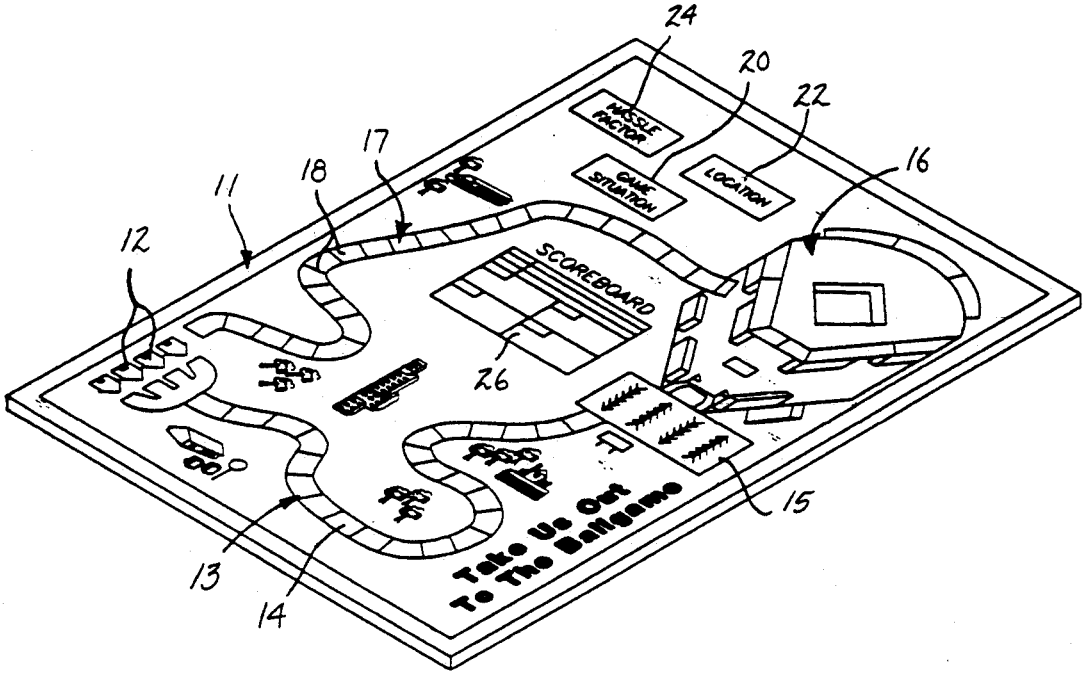
FIG. 1 is an isometric illustration of the game board of the invention.
Figure 2:
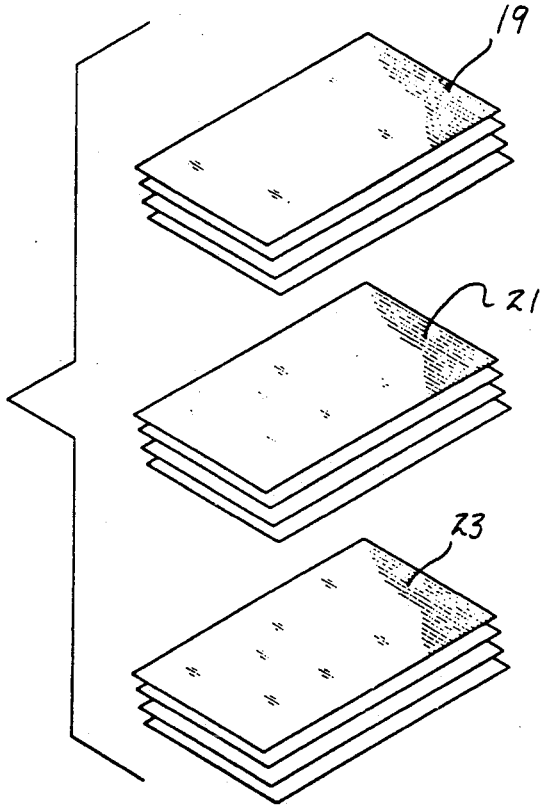
FIG. 2 is an isometric illustration of the three card decks employed by the invention.
Figure 3:
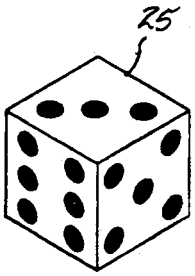
FIG. 3 is an isometric illustration of the die member employed by the invention.

With reference now to the drawings, and in particular to FIGS. 1 to 16 thereof, a new and improved baseball game apparatus embodying the principles and concepts of the present invention and generally designated by the reference numerals 11–43 will be described.

Figure 4:
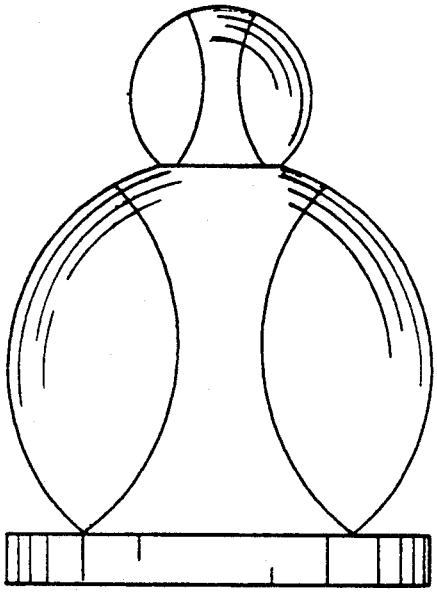
FIG. 4 is arranged for use as a single game token in lieu of the family token structure.
Figure 5:
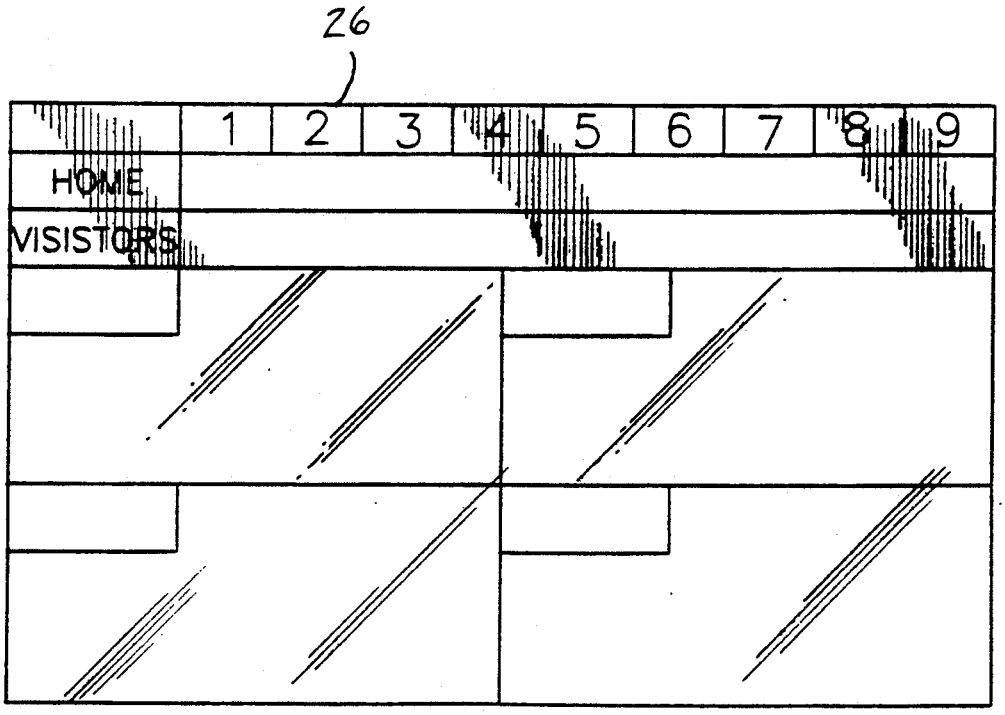
FIG. 5 is an orthographic view of the game scoring card structure.
Figure 6:
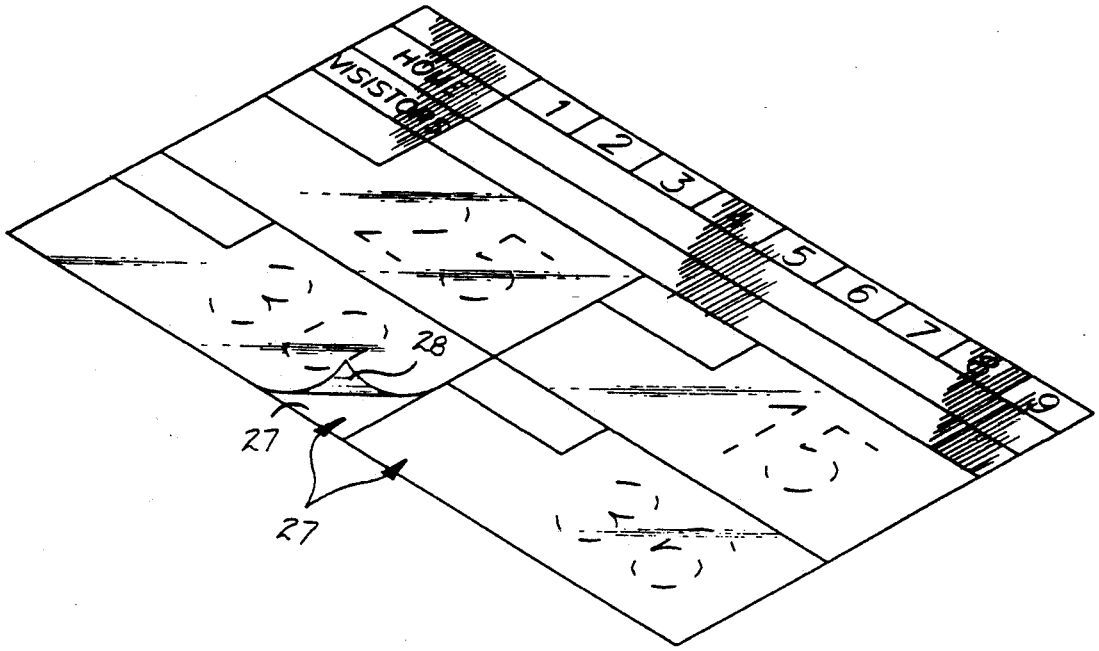
FIG. 6 is an isometric illustration of the game scoring card structure and associated erasable flap structure therewith.
Figure 7:
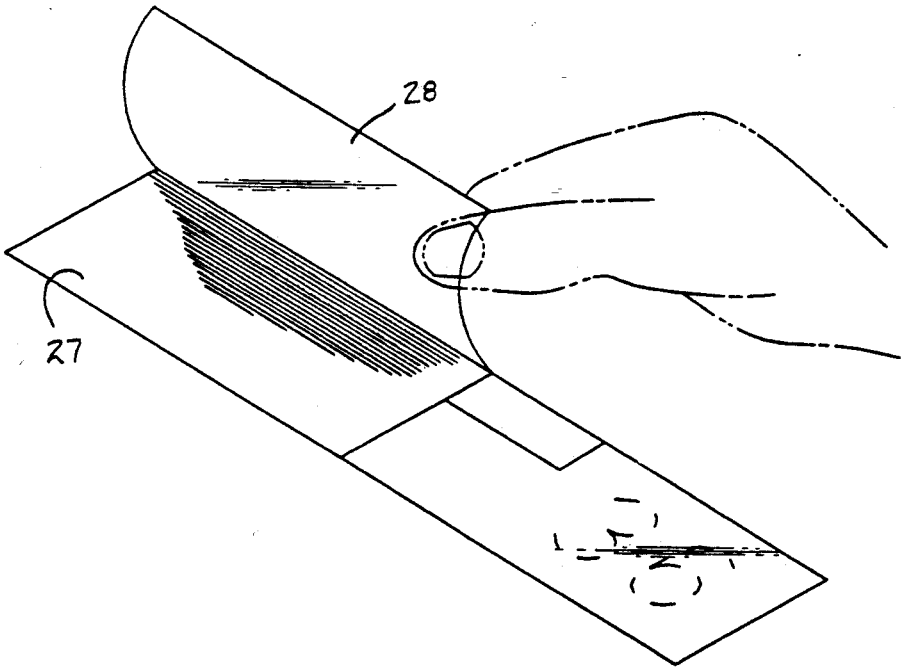
FIG. 7 is an isometric illustration of the erasable flap structure arranged in a raised orientation to effect erasure of an imparted enumeration.

More specifically, the baseball game apparatus of the instant invention essentially comprises a game board 11, having a row of start spaces 12, with a single start space associated with a family token structure indicated either as an individual token as indicated in FIG. 4, or preferably as a family token, to include the family car token 37 to contain a father token 38, a mother token 39, a simulation twelve year old son token 40, a ten year old daughter token 41, a six year old son token 42, and a one year old daughter token 43 to indicate the family token unit when positioned within the car token 37 for positioning within and movement along the first path 13 from the start spaces 12 to the parking lot space 15 for positioning of the family car token 37, with the individual family tokens 38–43 of each player positioned within the stadium space 16. Subsequent to play of the baseball simulation game, a second path 17 of second path spaces 18 is directed from the stadium space 16 back to the start spaces 12 for completion of the game board by individual players. The first path spaces 14, numbered one through twenty-three for twenty-three spaces, and the second path spaces 18, also of an equal number of spaces one through twenty-three, each include penalty and award spaces. Such by way of example is indicated as follows:

FREEWAY SQUARES

1. Flat tire lose one turn.
2. Stop for treats plus 15 pts.
3. Smooth traffic roll again.
4. Forgot tickets return home.
5. Traffic jam, lose 15 pts.
6. Found a short cut plus 15 pts.
7. Stop for gas minus 10 pts.
8. Sing songs to pass the time away plus 5 pts.
9. Mom packed food to eat on the way plus 15 pts.
10. Dad has to stop at work minus 10 pts.
11. The baby falls asleep, plus 10 pts.
12. The kids draw pictures on the way plus 5 pts.
13. Your son throws up in the car minus 20 pts.
14. Smooth sailing, roll again.
15. Dad tells funny jokes on the way, plus 5 pts.
16. The kids choose the radio station, minus 10 pts.
17. The kids are not fighting, plus 10 pts.
18. Car overheats. Lose a turn.
19. The air conditioner is turned on, plus 15 pts.
20. Dad's beeper goes off. Must call work, minus 10 pts.
21. You can see the ball park, plus 10 pts.
22. Kids are hyper, minus 10 pts.
23. You have a free parking coupon, plus 20 pts.

BACK ROAD SQUARES

1. Battery is dead. get a jump start, minus 20 pts.
2. Get out of parking lot quickly, roll again.
3. Stop for drinks, plus 10 pts.
4. Find some candy in the glove compartment, plus 10 pts.
5. Stop to get gas, minus 10 pts.
6. Stop for ice cream plus 15 pts.
7. Pit stop for restroom break, minus 10 pts.
8. Dad drag races another station wagon, plus 10 pts.
9. Your horn gets stuck minus 10 pts.
10. Everyone is behaving, plus 10 pts.
11. Dad bought a surprise at the game, plus 20 pts.
12. Pulled over for speeding, minus 30 pts. for the ticket.
13. Your son loses his hat out the window, minus 10 pts.
14. The kids all fall asleep, plus 10 pts for silence.
15. Your run over an animal, minus 15 pts.
16. Traffic thinning out. Roll again.
17. Stop for fast food, plus 15 pts.
18. It begins to rain, roads are slick. Minus 10 pts.
19. Flat tire. Lose a turn.
20. Your car is running well, plus 5 pts.
21. Someone ran over a skunk, minus 10 pts.
22. You are relieved to almost be home, plus 5 pts.
23. Sigh of relief as you come home, plus 15 pts.

Movement along the first path spaces 14 and the second path spaces 18 is effected by rolling of the die member 25 to indicate the number of spaces each player's family unit is to proceed along the respective first and second paths 13 and 17.

The object of the game is to accumulate the most "pleasure points" for an individual unit by game's end. The game is played with this regard. The game is played solitarily or by a plurality of players, with each player determining who will go in sequential order, typically by rolling the dice 25 to attain successively or successively low totals by the die member. The game board includes a first deck of game cards 19 known as "Situation cards" positioned within a first game card space 20. A second deck of game cards 21 known as "Location cards" is positioned within a second game card space 22. A third deck of game cards 23 known as "Hassle factor cards" is positioned within a third game space 24. A scoring space 26 divided into scoring space sections 27 is provided, with each of the sections having a second base 28 and an overlying polymeric web overlay 29 arranged for lifting relative to the underlying section base 28 to permit for the erasure of numerical totals imparted upon each of the sections 27.

Initially, each of the family tokens, including the tokens 37–43, proceed along the first path spaces 14 to attain or be penalized in various point totals of game points. It should be noted that at no point may any one player be afforded less than zero point total. More than one family car token 37 and associated family members therewithin may occupy a single space at any one time of the spaces 14 or 18. Families proceed along the first path 13 to the parking lot space 15 to park the family car token 37 and position the family tokens on the stadium space 16 relative to each of the players. The first two families to arrive at the stadium space 16 are awarded a bonus of fifty points. Subsequent families receive no bonus points. Further, the stadium space 16 may be demarcated into "box seats" and "general admission" to further demarcate the earlier arriving family token groups.

Upon being seated in the stadium space of the first two families, those not having reached the space for the parking lot space 15 may be provided an additional turn to reach the spaces 15 and 16. Subsequently, those families that have not yet arrived at the stadium space will not permitted to draw the second and third game cards 21 and 23 but must continue to roll the dice member 25 until they are seated.

The baseball game itself requires nine innings or nine complete turns for each player, and each inning being considered one turn.

At each inning, and upon each turn of by each player, the drawing of three different cards of the first, second, and third game cards 19, 21, and 23 will be drawn by each player. It should be noted that the first, second, and third game cards 19, 21, and 23 each include various penalties and awards in play. For example, the following are exemplary and are not limiting relative to the "hassle factor cards" or third game cards 23:

You are engulfed in the excitement of the game when your six year old son spills his entire cup of root beer, which you had just purchased for him. Minus 15 pleasure points.

The stadium is filled to its capacity tonight. The lines to buy tickets were extremely long. Just the thought of the long wait you suffered causes you to lose 5 pleasure points.

The umpiring of this game is much to be desired. Minus 5 pleasure points. But yelling at them at the top of your lungs awards you 10 pleasure points.

The best thing about tonight's game is that your neighbor could not come and he gave you his seats for the evening. Plus 50 pleasure points for free tickets.

Further, examples of the second game cards 21 are as follows:

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Remain in your seats this turn. Keep this card. Receive 25 pleasure points.

Skipping down the aisles headed to the concession stands your ten year old daughter slips and falls. After slightly spraining her ankle you spend the entire inning getting it wrapped at the first aid booth. Minus 25 pleasure points for her mishap.

Your oldest son tries to impress some girls sitting close to him by jumping over a railing. To his embarrassment and misfortune his foot gets caught causing him to land on his head. He's ok but his ego is damaged. Spend one inning at the first aid station checking him out. Minus 25 pleasure points.

Restroom time. Take the children to the restrooms during this inning. Minus 25 points for not seeing the action on the field.

Restroom time. Take the children to the restrooms during this inning. Minus 25 points for not seeing the action on the field.

The tribe is hungry. Spend this turn at the concession stand missing an inning of the thing you came to see, the baseball game, minus 25 pleasure points.

The kids feel it necessary to get something to remember the game by. Spend one turn at the souvenir stand. Minus 25 pleasure points.

The first game cards or "game situation cards" indicate game play, as indicated by example as follows, on pages 26 to 29.

It should be noted that the examples per the game cards 19, 21, 23 are exemplary and any total of cards may be employed subject to the imagination and desire of individuals in play of the game. Typically as a minimum twenty to twenty-five cards should considered a minimum in play of any of the individual decks of game cards 19, 21, and 23. In play of the first game cards 19, should the number of hits, runs, and the like are imparted upon the score board space 26 in consistency with the essence of a baseball game during play of the game of the invention.

Subsequent to completion of nine innings of the baseball game, the families need to be positioned back in their individual family car tokens 37 to proceed along the second path 17 of the second path spaces 18 and the associated awards and penalties as noted above to return to an individual start space 12. The first family to obtain landing upon a start space 12 is awarded fifty additional points for beating the other teams and traffic. The family with the most points is declared the winner and relative enthusiasm in play of the game may be arbitrarily demarcated such as the following:

600 points or more—Ultimate Family Baseball Fans.
450 points to 599—Super Family Baseball Fans.
300 points to 449—Pretty Big Family Baseball Fans.
150 points to 299—Average Family Baseball Fans.
0 points to 149—Horrible Family Baseball Fans.

The home team scores four runs on two hits and two walks. One hit includes a grand slam. The visiting team is shut out with one hit and no runs scored.

Neither team is able to score a run, with the home team collecting one hit and the visitors no hits.

Big inning for the visitors as they score three runs on two hits and a hit batter. Unfortunately for the home they are shut down on no hits and no runs.

Brilliant pitching on both sides, as both teams are set down in order with no runs or hits for either team.

Both teams are able to pitch out of tight situations. No runs are scored while the home team collects two hits and the visitors one.

Pitchers duel this inning, no runs or hits for either team.

Lots of action this inning. The visitors begin with three runs on three hits, and the home team counters with three runs as well on four hits.

The visitors manage two hits but are unable to bring anyone across. The home team gets two hits as well and brings home one on a wild pitch.

The visitors are able to load the bases on three walks, but then amazingly strike out three times in a row. No runs or hits as well for the home team.

Fireworks for both teams this inning. The visitors get a single run on one solo home run hit. The home club get two runs on two hits including a two run homer.

Boring inning as the visitors hit into three ground outs. The home team flys out twice and strikes out once. No runs or hits for either team.

The visitors gain a walk and then a triple scoring the runner for their only hit and run of the inning. However the home team rallies for two runs on three hits.

Despite very loud cheering the vising team slugs the ball hard and scores twice on a single and a towering home run. The home team struggles to get one hit and does not score a run to the disappointment of the fans.

Huge inning for the visitors. A double, two walks and a grand slam. Two hits and four runs. The dejected home club strikes out three straight times against a pumped up pitcher.

Visitors are held both scoreless and hitless this inning. The home team manages to get two hits and push one run across.

A quick inning for both teams. One, two, three outs for both teams.

This inning both teams play very hard and are able to gain one run apiece. The visitors get a single, a stolen base, and another single to score the first batter. The home team gets a double and then a single to get their run.

The home team pitcher bears down and stops the visitors cold with no runs or hits. However, his team is only able to come up with one hit and no runs themselves.

Both sides are shut down completely this inning. No runs on no hits. Do the wave and cheer loud for the home team.

Real excitement this inning. The visitors lead off with a double and then score on the next play due to an error. One hit, one run. The home team gets fired up with a single and then a homer by the guy who made the error. Two runs, two hits.

Things are calm this inning. The visitors get one hit, but no runs. Inspired by the team mascot the home club gets two hits but both runs are left stranded for no runs.

Figure 8:
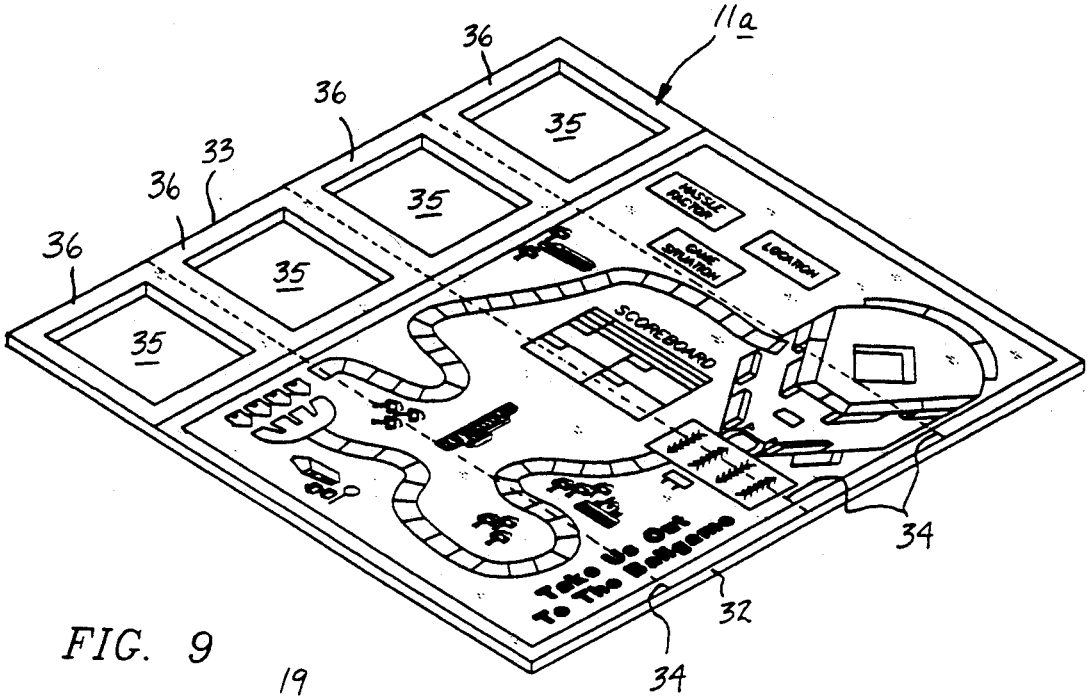
FIG. 8 is an isometric illustration of a modified game board arrangement.
Figure 9:
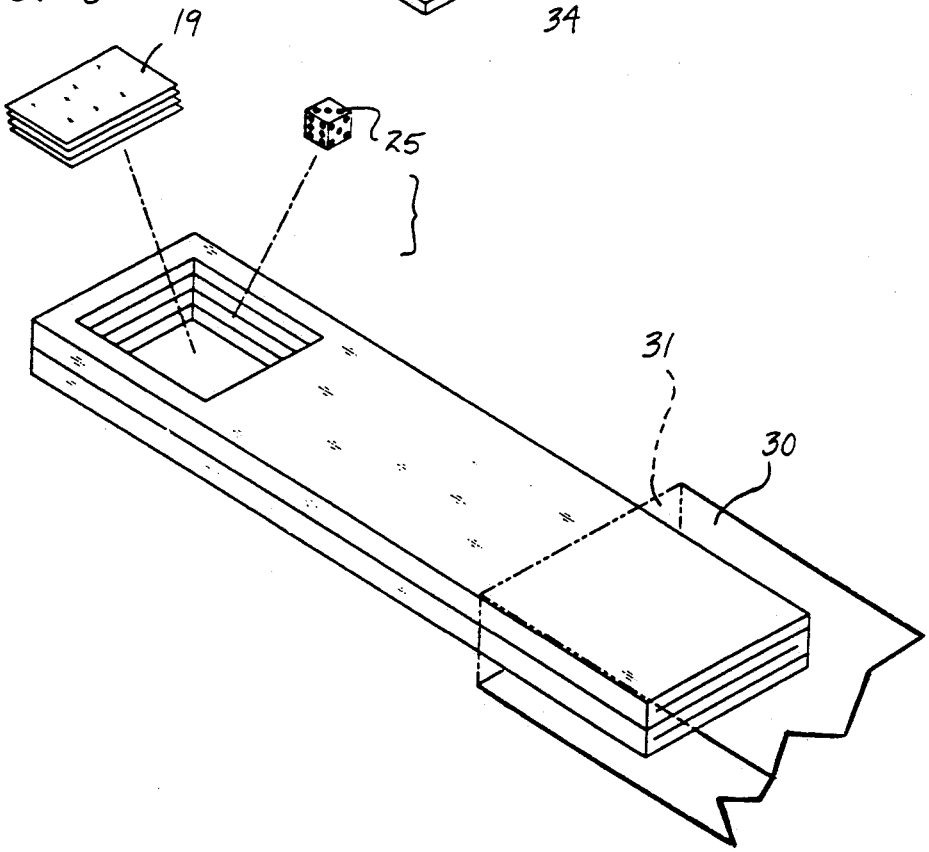
FIG. 9 is an isometric illustration of the modified game board arranged for containing various game components therewithin.
Figure 10:
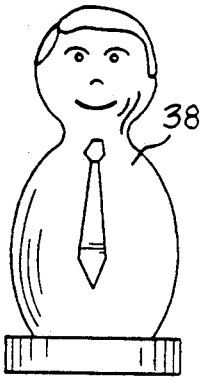
FIGS. 10–16 are orthographic views of the family unit tokens arranged for movement along the game board.
Figure 11:
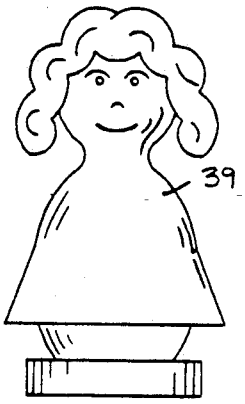
Figure 12:
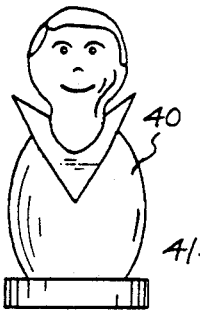
Figure 13:
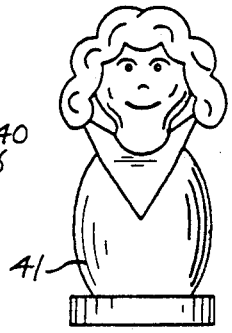
Figure 14:
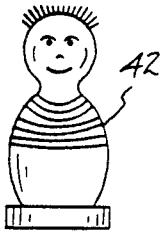
Figure 15:
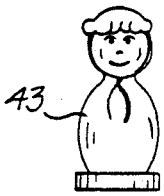
Figure 16:
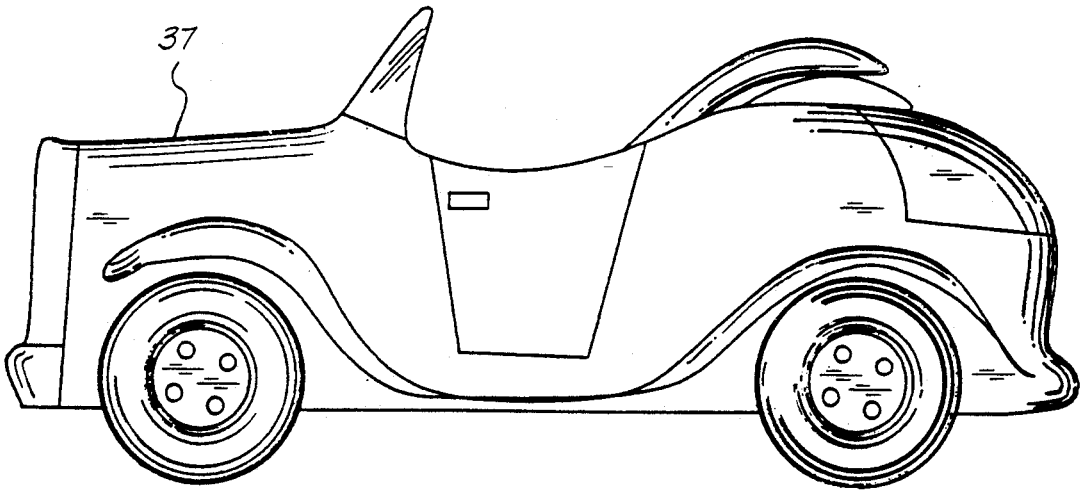

The FIGS. 8 and 9 indicates the use of a modified game board 11*a* having reception within a tubular container 30 of a parallelepiped configuration, with the tubular container 30 having an entrance opening 31. The game 11*a* includes a game board first side 32 spaced from a second side 33, with three hinge lines 34 orthogonally directed between the first and second sides 32 and 33, with a row of game board openings 35 arranged parallel to the second side 33, whereupon interfolding of the game board, in a manner as indicated in FIG. 9, provides for a longitudinally aligned array of the game board openings 35. In this manner, the game cards 19, 21, and 23 may be positioned within the unitary opening defined by the alignment of the game board openings 35, as well as the dice member 25 and the various tokens and upon positioning of the game board within the container 30, provides for ease of storage in various components of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A baseball game apparatus, comprising, a game board, the game board including a plurality of start spaces, and a first serpentine path having a predetermined number of first path spaces, with the first path spaces indicating alternatively an award or penalty of points, with a parking lot space, with the first path extending from the start spaces to the parking lot space, and a stadium space positioned in adjacency to the parking lot space, and a second path of second path spaces, with the second path spaces indicating said penalty and award of said points, and the second path extending from the stadium space to the start spaces, and a deck of first game cards, with a first game card space positioned upon the game board to receive cards, and a second deck of game cards at a second game card space positioned upon the game board for receiving the second deck of game cards, and a third deck of game cards, and a third game card space positioned upon the game board for receiving the third deck of game cards, and a dice member for directing movement along the first path and the second path, and each player having a family token unit, wherein each family token unit is arranged for movement along the first path, the second path, the parking lot space, and the stadium space, wherein each family token unit includes a family car token removably mounting a father token, a mother token, and a plurality of children tokens, and the father token, the mother token, and the children tokens are arranged for positioning within the stadium space upon the family car token being received within the parking lot space, and each player sequentially upon positioning the father token, mother token, and children token of said player within the stadium space sequentially selects one of said first game cards, one of said second game cards, and one of said third game cards, wherein the first game cards indicate point total of a baseball game, wherein each of the second game cards and the third game cards effects selectively award and loss of game points, and the game board includes a game board first side spaced from and parallel a game board second side, and the game board includes a plurality of linear hinges orthogonally directed between the first side and the second side, wherein the linear hinges equal a hinge line total, and a plurality of game board openings aligned in a row, wherein said row is arranged parallel to and adjacent the second side, and the game board openings equal a further total equal to said hinge line total plus one, wherein the game board openings are arranged for alignment relative to one another and in communication relative to one another when said game board is interfolded about the linear hinges, and the first, second, and third game cards, the family car token units, and the dice member are arranged for reception within the game board openings, wherein the game board openings are aligned relative to one another, and a tubular container of parallelepiped configuration arranged for receiving the game board in the interfolded configuration.

* * * * *